US009790601B2

(12) United States Patent
Lambourne et al.

(10) Patent No.: US 9,790,601 B2
(45) Date of Patent: Oct. 17, 2017

(54) MARINE CATHODIC PROTECTION SYSTEM

(71) Applicant: ROLLS-ROYCE PLC, London (GB)

(72) Inventors: Alexis Lambourne, Derby (GB); Leslie Callow, Frodsham (GB)

(73) Assignee: ROLLS-ROYCE PLC, London (GB)

( * ) Notice: Subject to any disclaimer, the term of this patent is extended or adjusted under 35 U.S.C. 154(b) by 231 days.

(21) Appl. No.: 14/935,936

(22) Filed: Nov. 9, 2015

(65) Prior Publication Data

US 2016/0138173 A1 May 19, 2016

(30) Foreign Application Priority Data

Nov. 17, 2014 (GB) ..... 1420357.4

(51) Int. Cl.
*C23F 13/02* (2006.01)
*C23F 13/20* (2006.01)
(Continued)

(52) U.S. Cl.
CPC ..... *C23F 13/20* (2013.01); *B63B 59/04* (2013.01); *C23F 13/06* (2013.01); *C23F 13/14* (2013.01);
(Continued)

(58) Field of Classification Search
CPC ..... C23F 13/02; C23F 13/06; C23F 13/08; C23F 13/12; C23F 13/14; C23F 13/16;
(Continued)

(56) References Cited

U.S. PATENT DOCUMENTS 4,061,965 A 12/1977 Nelson
4,549,949 A 10/1985 Guinn
(Continued)

FOREIGN PATENT DOCUMENTS

EP 2592175 A2 5/2013
GB 2474084 A 4/2011

OTHER PUBLICATIONS

Mar. 18, 2016 Search Report issued in European Patent Application No. 15193584.
(Continued)

*Primary Examiner* — Luan Van
*Assistant Examiner* — Alexander W Keeling
(74) *Attorney, Agent, or Firm* — Oliff PLC

(57) ABSTRACT

A marine cathodic protection system configured to protect a metal structure exposed to seawater from corrosion. The system includes a first anode provided on or adjacent the protected metal structure at a first position. The first anode is exposed to seawater, is electrically insulated from the protected metal structure, and is formed of a metal having a greater negative potential than the protected metal. The system further includes a second anode provided on or adjacent the protected metal structure at a second position. The second anode is electrically connected to the first anode. The first position is preferably substantially submerged in said seawater such that the protected metal and the first anode cooperate to define a seawater battery configured to apply an electrical current to the second anode, the second anode thus being an impressed current anode.

15 Claims, 5 Drawing Sheets

(51) Int. Cl.

| | |
|---|---|
| ***C23F 13/06*** | (2006.01) |
| ***C25C 3/10*** | (2006.01) |
| ***C25C 7/06*** | (2006.01) |
| ***B63B 59/04*** | (2006.01) |
| ***C23F 13/14*** | (2006.01) |
| ***C23F 13/16*** | (2006.01) |

(52) U.S. Cl.
CPC ..... *C23F 13/16* (2013.01); *C25C 3/10* (2013.01); *C25C 7/06* (2013.01); *C23F 2213/21* (2013.01); *C23F 2213/31* (2013.01); *C23F 2213/32* (2013.01)

(58) Field of Classification Search
CPC .. C23F 13/20; C23F 2213/20; C23F 2213/21; C23F 2213/30; C23F 2213/31; C23F 2213/32; B63B 59/04; B63B 59/00–59/10; B63B 17/00–17/06; B63B 2209/04
USPC ..... 204/196.01, 196.1, 196.15, 196.27, 204/196.37
See application file for complete search history.

(56) References Cited

U.S. PATENT DOCUMENTS

| | | | | |
|---|---|---|---|---|
| 4,822,698 | A | 4/1989 | Jackovitz et al. | |
| 5,055,165 | A * | 10/1991 | Riffe | B08B 17/02 204/196.3 |
| 8,118,983 | B1 * | 2/2012 | Anderson | C23F 13/04 204/196.01 |

OTHER PUBLICATIONS

Apr. 22, 2015 Search Report issued in British Patent Application No. GB1420357.4.

* cited by examiner

MARINE CATHODIC PROTECTION SYSTEM

The present invention relates to a marine cathodic protection system, and more particularly relates to such a system configured to protect a metal structure exposed to seawater from corrosion.

Corrosion of metal structures in a marine environment is a significant problem. Where metal structures such as ships, oil rigs, bridge piles and the like are in contact with seawater, the metal is susceptible to corrosion. This can be exacerbated if the seawater is aerated which is usually the case in the turbulent region around a ship's propeller, or around the legs of an oil rig or the piles of a bridge structure, for example. The salt content of seawater increases electrical conductivity and accelerates the aqueous corrosion process.

There have been proposed previously a number of different ways to protect metal in the marine environment from corrosion. Some of these are extremely simple, such as painting the metal with protective paint. However, this is generally insufficient because of course paint is susceptible to damage and deterioration over time, and so simply painting a metal structure is not a complete solution to the problem of corrosion.

It has therefore been proposed previously to protect metal from marine corrosion by using passive cathodic protection systems in which one, or more usually a plurality of galvanic anodes are attached to the vulnerable metal surface where it is exposed to seawater. FIG. 1 shows the electrochemical series for a range of different metals in seawater at 20° C., which can be used to select an appropriate metal for the anodes in such a system. In this respect, the anode(s) must be made from a less noble (i.e. more anodic) metal having a greater negative potential than that which is to be protected, so in the usual case of a steel structure requiring protection then aluminium, zinc or magnesium represent useful materials from which to form sacrificial anodes (noting that beryllium is highly toxic and very expensive).

In this type of system the two dissimilar metals represented respectively by the anode and the structure to be protected (i.e. the cathode) are both submerged in the seawater (an electrolyte), such that a galvanic cell is formed. The anode thus becomes the target of corrosion, thereby "sacrificing" itself and, in turn, protecting the metal of the structure. It is for this reason that such anodes are commonly known as "sacrificial anodes". Because of their sacrificial nature, the anodes in this type of system become consumed over time and require periodic replacement.

Because, as mentioned above, turbulent water flow and the resulting aeration accelerates corrosion, it is generally necessary to apply more sacrificial anodes around the area of ships' propulsive devices in order to provide adequate corrosion protection in these areas, because they are particularly susceptible to high levels of water turbulence.

In some applications, such as ships or other marine vehicles which are required to move through water with minimal resistance, sacrificial anodes affixed to the structure represent sites of increased hydrodynamic drag. Whilst this can be addressed to a certain degree by designing the anodes such that they have a streamlined shape, this represents an inherent penalty of the sacrificial anode system. Nevertheless, this remains a very widely used type of system due to its low capital cost and relatively low ongoing cost in service.

An alternative type of system for corrosion protection in the marine environment is the so-called impressed current cathodic protection ("ICCP") system, which can be particularly attractive for larger structures. In this type of system anodes are connected to a DC power supply such a battery or a transformer-rectified connected to AC mains power. More particularly, the negative terminal of the DC power supply is connected to the metal structure to be protected, and the positive terminal of the DC power supply is connected to the anode(s). FIG. 2 represents a schematic illustration of an ICCP system used to protect a steel structure 1 in seawater 2, and comprises an impressed current anode 3 which is also submerged in the seawater 2 and is connected to the positive terminal of a DC power supply 4 via an insulated anode cable 5. The negative terminal of the DC power supply 4 is connected to the steel structure 1 via a negative return cable 6. Typical materials for the impressed current anodes 3 in this type of system include cast iron, graphite, mixed metal oxide, platinum and niobium. Most ICCP arrangements include sophisticated control systems to control and adjust the impressed DC current in order to optimise the system to varying conditions or requirements Whilst ICCP systems work well, they are not without disadvantages. For example, these systems are significantly more complicated than sacrificial anode systems, and of course they require an electrical power supply, which is often not available or convenient on small vessels.

It is an object of the present invention to provide an improved marine cathodic protection system According to a first aspect of the present invention, there is provided a marine cathodic protection system configured to protect a metal structure exposed to seawater from corrosion; the system comprising a first anode provided on or adjacent the protected metal structure at a first position, the first anode being exposed to seawater and electrically insulated from the protected metal structure, and which is formed of a metal having a greater negative potential than the protected metal; and a second anode provided on or adjacent the protected metal structure at a second position, wherein the second anode is electrically connected to the first anode.

Preferably, said first position is substantially submerged in said seawater such that the protected metal and the first anode cooperate to define a seawater battery configured to apply an electrical current to the second anode, the second anode thus being an impressed current anode.

Advantageously, the first anode is mounted to the protected metal structure.

Advantageously, the second anode is electrically connected to the metal structure.

The first anode may be mounted to the protected metal structure with an electrically insulating material located between the first anode and the protected metal structure.

Conveniently, the second position is remote from the first position, and the second anode is electrically connected to the first anode by an insulated cable.

Advantageously, the second position is also either submerged in said seawater, or otherwise exposed to said seawater.

Preferably, said protected metal structure forms at least part of a marine propulsion device.

Advantageously, said protected metal structure forms part of a propulsive water-jet system for a marine vessel.

Preferably, said protected metal structure comprises a first portion subjected to a relatively low velocity water flow in use, and a second portion subjected to a relatively high velocity water flow in use, the first anode being mounted to the first portion, and the second anode being mounted to the second portion.

Conveniently, said water-jet system comprises an external part which is located externally of the vessel's hull for submersion in seawater, and an intake duct, at least part of which is located internally of the vessel's hull and which defines a flow channel for the intake of water, said first position being on or adjacent the external part, and said second position being within or adjacent said flow channel.

Preferably, said second anode is recessed into said duct for exposure to water flowing through the duct.

Optionally, at least part of said second anode is provided flush with a surface of said duct defining said flow channel.

Said metal structure may be formed substantially of a metal selected from the group comprising: steel, stainless steel, and aluminium.

Said first anode may be made from a material selected from the group comprising: magnesium, zinc and aluminium, or alloys formed substantially of magnesium, zinc or aluminium.

Said second anode may be made from a material having a less negative potential than the first anode, and may be made from a corrosion resistant conductive material such as a material selected from the group comprising: magnetite, carbonaceous materials, silicon iron having a silicon content of between 14% and 18%, lead/lead oxide, lead alloys and platinised materials.

Said second anode is optionally made from graphite.

Alternatively, said second anode is made from a platinised material selected from the group comprising: tantalum, niobium and titanium.

According to a second aspect of the present invention, there is provided a marine vessel provided with a system according to the first aspect.

So that the invention may be more readily understood, and so that further features thereof may be appreciated, embodiments of the invention will now be described by way of example with reference to the accompanying drawings in which.

Figure 3:
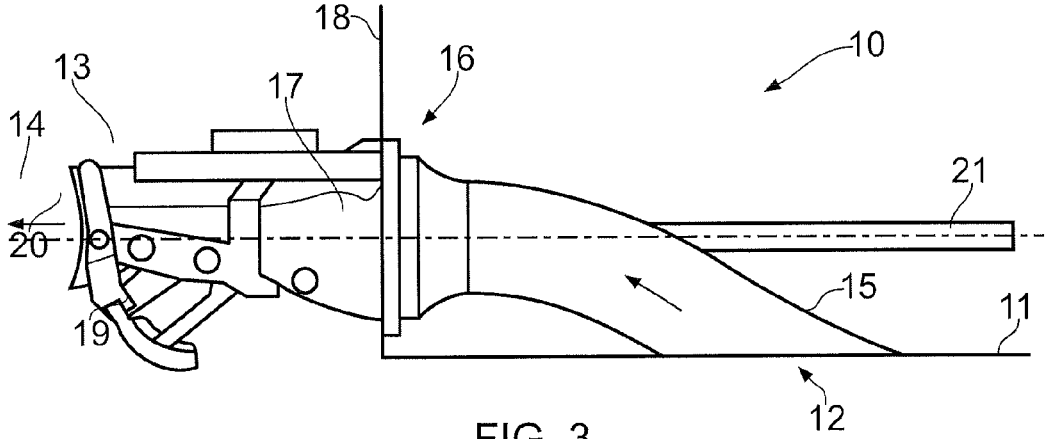
FIG. 3 shows a conventional marine propulsion unit in the form of a water-jet.

Turning now to consider FIGS. 3 to 8 in detail, FIG. 3 illustrates a typical marine water-jet unit 10, which represents a type of marine propulsion device which it has been found is particularly difficult to protect effectively from corrosion. The water-jet is illustrated in combination with the hull 11 of a small marine vessel.

As will be appreciated by those of skill in the art of marine propulsion, a water-jet device basically comprises a powerful water pump which sucks up water from outside the vessel, via a water intake opening 12 in the bottom of the vessel's hull, and which accelerates the water before ejecting it through a nozzle 13 towards the rear of the arrangement. The reaction force arising from the powerful ejection of the water through the nozzle 13, as denoted by arrow 14 in FIG. 3, serves to propel the vessel (towards the right in the orientation illustrated in FIG. 3).

In more detail, it will be noted that the water-jet device 10 comprises an internal intake duct 15 which is arranged inside the vessel's hull 11 so as to extend from the intake opening 12 towards the device's pump, indicated generally at 16 in FIG. 3. The intake duct 15 thus defines a flow channel for the intake of water to the water-jet 10. The water-jet further comprises a housing 17, which may contain the pump 16, and which is usually mounted to the hull's transom 18, so as to extend through the transom 18, as illustrated. At least part of the housing 17 is thus provided external of the vessel's hull, and carries the nozzle 13 which may be directional so as to provide steering functionality, and optionally other components such as a thrust-reversing mechanism 19.

FIG. 3 also illustrates the typical level of the water, which thus represents the vessel's notional waterline 20. FIG. 3 illustrates the vessel's hull 11 in its normal attitude at rest, and it will therefore be noted that in this position a significant external part of the housing 17 is submerged beneath the waterline 20. Even when the vessel is moving forwards at significant speed, such that the vessel adopts a bow-up attitude in which the stern (i.e. the region illustrated in FIG. 3) becomes lowered, a significant external part of the housing will remain submerged.

The structure of the water-jet 10 is typically made from metal such as low alloy steel, stainless steel or aluminium, including notably the intake duct 15, the housing 17 and its associated external parts such as the nozzle 13 and thrust-reversing mechanism 19. The metal structure of the water-jet 10, including the intake duct 15 on account of its exposure to intake seawater flowing therethrough, is thus susceptible to seawater corrosion and therefore requires protection. It has been found to be particularly problematic to provide effective corrosion resistance inside the intake duct 15 via conventional systems, without adversely affecting the operational performance of the water-jet.

Figure 4:
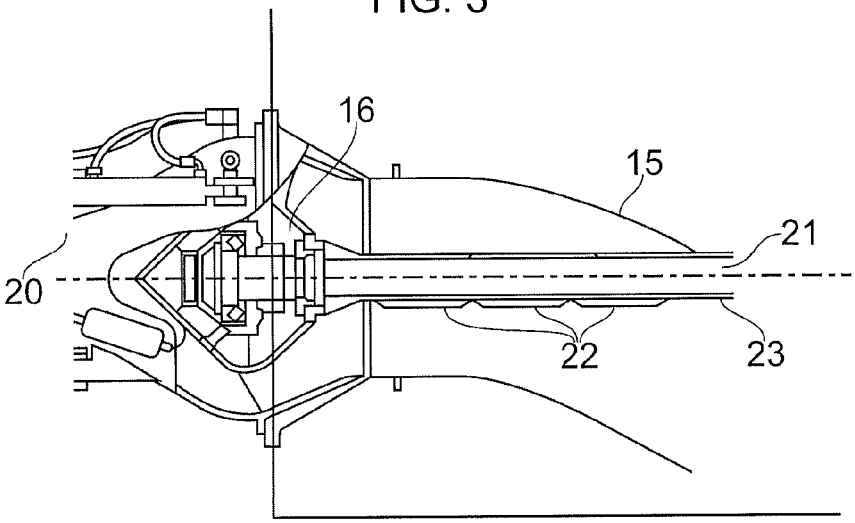
FIG. 4 is a cross-sectional illustration, showing the water-jet of FIG. 4 provided with a conventional sacrificial anode system for corrosion protection within an intake duct of the water-jet.

FIG. 4 illustrates schematically one proposed arrangement of sacrificial anodes for protecting the intake duct 15 from corrosion. As will be noted, FIG. 4 is a cross-sectional diagram and thus shows a pump drive shaft 21 (also shown in FIG. 3) which extends through and across part of the intake duct 15 and which serves to connect the pump 16 to a suitable source of mechanical power such as an engine in order to drive the pump. A plurality of galvanic anodes 22 are fitted to a protective tube 23, which is coaxial with and provided around the drive shaft 21, such that the anodes 22 are provided in the intake flow of water which is drawn through the intake duct 15 during operation of the water-jet, and which will also be submerged in water when the vessel is at rest with the water-jet inoperative, as illustrated. As will be appreciated, in the case of the intake duct 15 being formed of low alloy steel or (less commonly) aluminium, the anodes 22 may be formed of, for example, zinc or magnesium and therefore become sacrificed and corrode in preference to the steel or aluminium of the intake duct 15.

However, it has been found that fitting of the anodes 22 to the protective tube 23 in this manner causes both assembly and maintenance problems due to the relative inaccessibility of their position, which can lead to the anodes 22 not being fitted at all, being fitted incorrectly, or not being replaced as they should be during service, which can lead to unacceptable levels of corrosion to the intake duct 15, but also to other parts of the water-jet unit in the area of the pump 16.

Figure 5:
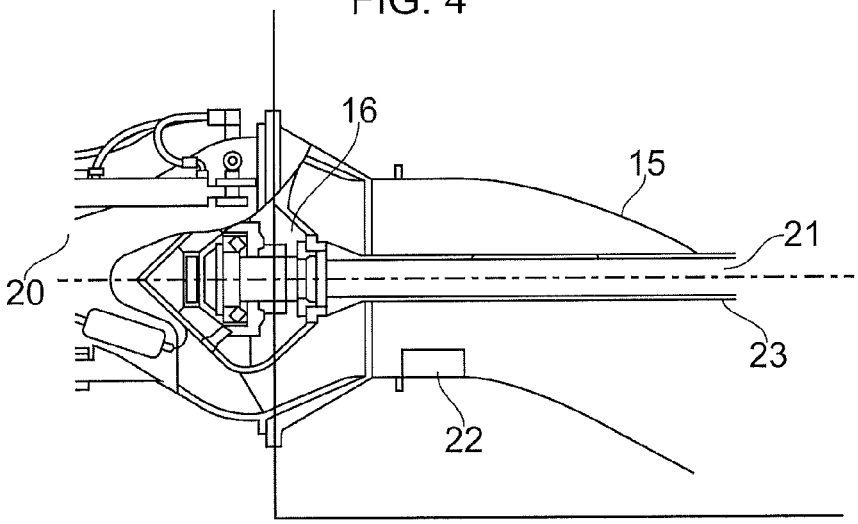
FIG. 5 is a cross-sectional illustration similar to that of FIG. 4, but which shows an alternative sacrificial anode arrangement.

An alternative approach is that illustrated in FIG. 5, in which it will be noted that instead of fitting the anodes 22 to the protective tube 23 around the drive shaft 21, an anode 22 is instead fitted directly to the innermost surface of the intake duct 15. It will of course be appreciated that more than one anode 22 could be fitted to the innermost surface of the intake duct 15 in this manner. However, in this type of arrangement, it has been found that the or each anode 22 causes unacceptable turbulence in the intake flow of water drawn through the intake duct 15, which can adversely affect the performance of the water-jet unit 10.

Figure 6:
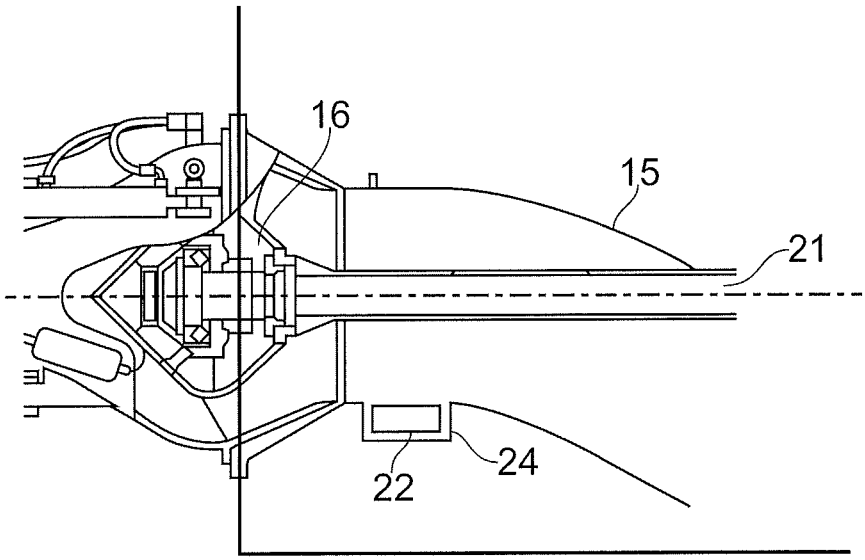
FIG. 6 is another cross-sectional illustration, similar to that of FIG. 5, but which shows another alternative sacrificial anode arrangement.

The above-described problem associated with the arrangement illustrated in FIG. 5 can, to a certain degree, be mitigated by providing the or each anode 22 within a recess 24 in the wall of the intake duct 15, as illustrated in the arrangement of FIG. 6. Whilst this type of arrangement does mean that the anodes 22 do not project into the intake water flow passing through the intake duct 15, as the anodes 22 become depleted via sacrificial corrosion from the top, steps will be provided in the duct 15 which will steadily grow in depth over time, and which will of course create their own turbulence issues.

Figure 7:
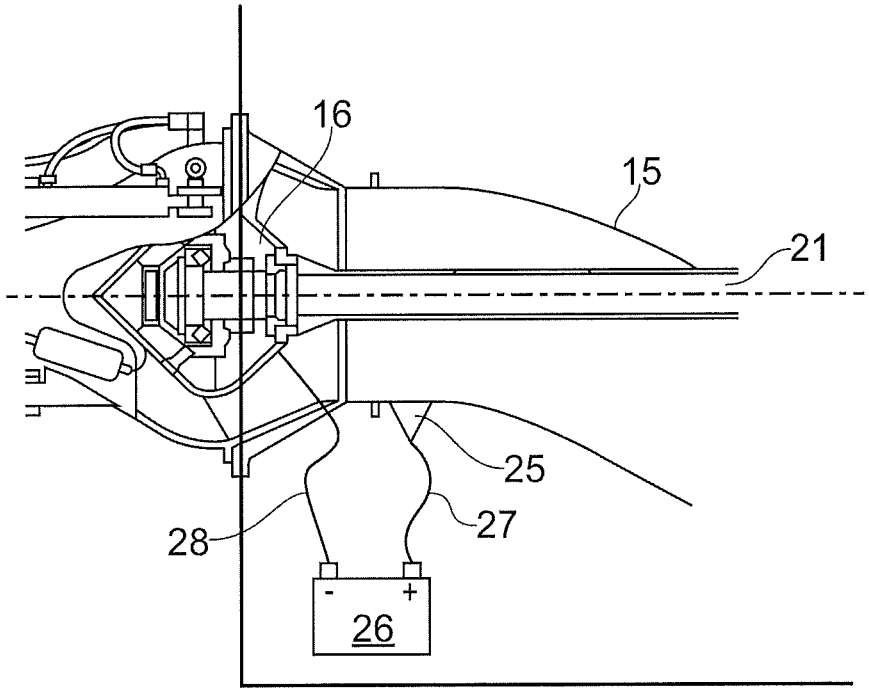
FIG. 7 is another similar cross-sectional illustration, but which shows an impressed current cathodic protection system arranged to provide corrosion protection to the intake duct of the water-jet.

An alternative system to provide corrosion protection inside the intake duct 15 is illustrated schematically in FIG. 7, and may take the form of an ICCP system. In this arrangement, one or more "permanent", insoluble and hence non-sacrificial impressed current anodes 25 are provided. The or each impressed current anode 25 may, for example, be made from graphite, and is provided flush to the innermost surface of the intake duct 15 as illustrated.

The impressed current anode 25 is electrically connected to the positive terminal of a DC power supply 26, such as a battery, via an insulated anode cable 27, with the negative terminal of the power supply 26 being electrically connected to the metal structure of the water-jet via a negative return cable 28, as illustrated, thereby defining a complete ICCP system.

Whilst the ICCP system illustrated in FIG. 7 can be effective in addressing the above-described turbulence-inducing problems associated with sacrificial anodes provided within the intake duct 15 of the water-jet 10, it represents a significantly more complicated system which is entirely dependent on their being a convenient and reliable source 26 of DC electrical power. This can represent a significant problem for many small vessels which may lie at rest in the water for long periods of time which can result in an on-board battery running flat. In some instances, there might not be any convenient source of DC power at all.

Figure 8:
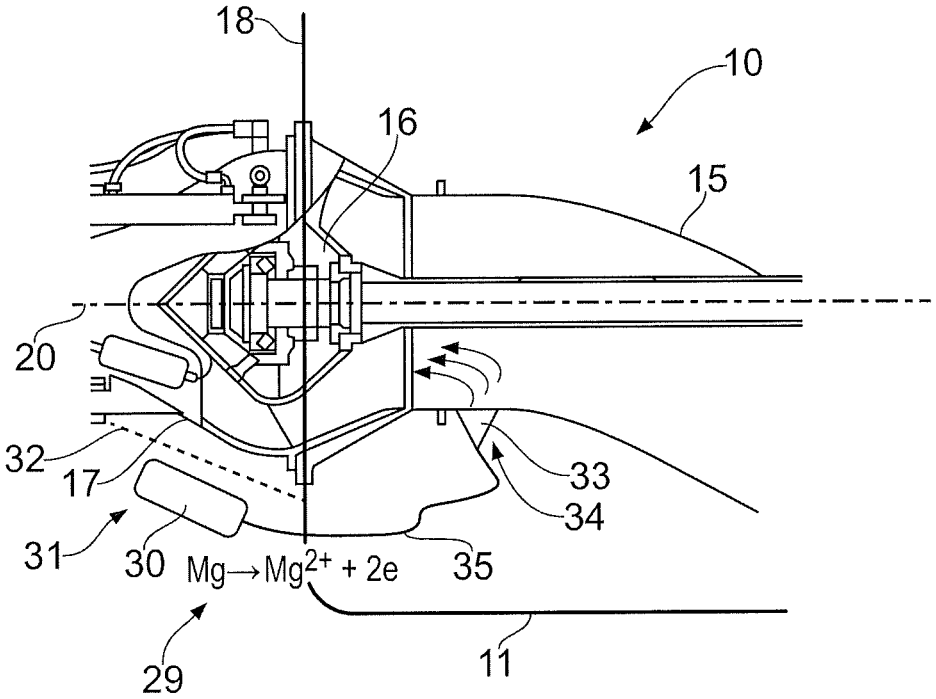
FIG. 8 is a schematic cross-sectional illustration showing the water-jet with an exemplary cathodic protection system in accordance with an embodiment of the present invention.

Turning now to consider FIG. 8, there is illustrated an exemplary marine cathodic protection system 29 in accordance with the present invention, arranged to provide corrosion protection to the metal structure of a water-jet arrangement 10 having the same general configuration to the above-described water-jet arrangements illustrated in FIGS. 3 to 7 and which is thus denoted by the same reference numbers.

The protection system 29 comprises a first anode 30, which is a simple galvanic anode similar to the conventional sacrificial anodes 22 described above. The first anode 30 is provided on, or adjacent a first part of the metal structure of the water-jet 10 at a first position 31. In the particular arrangement illustrated, the first anode 30 is provided adjacent the external part of the water-jet's housing 17 such that it will be substantially submerged in the seawater (whose level is indicated at 20). The first anode 30 is electrically insulated from the metal structure of the housing 17, via a layer of insulating material 32. In preferred arrangements it is envisaged that the first anode 30 will actually be removably mounted to the external part of the water-jet housing 17, with the insulating material 32 located between the anode 30 and the metal of the housing 17.

Figure 1:
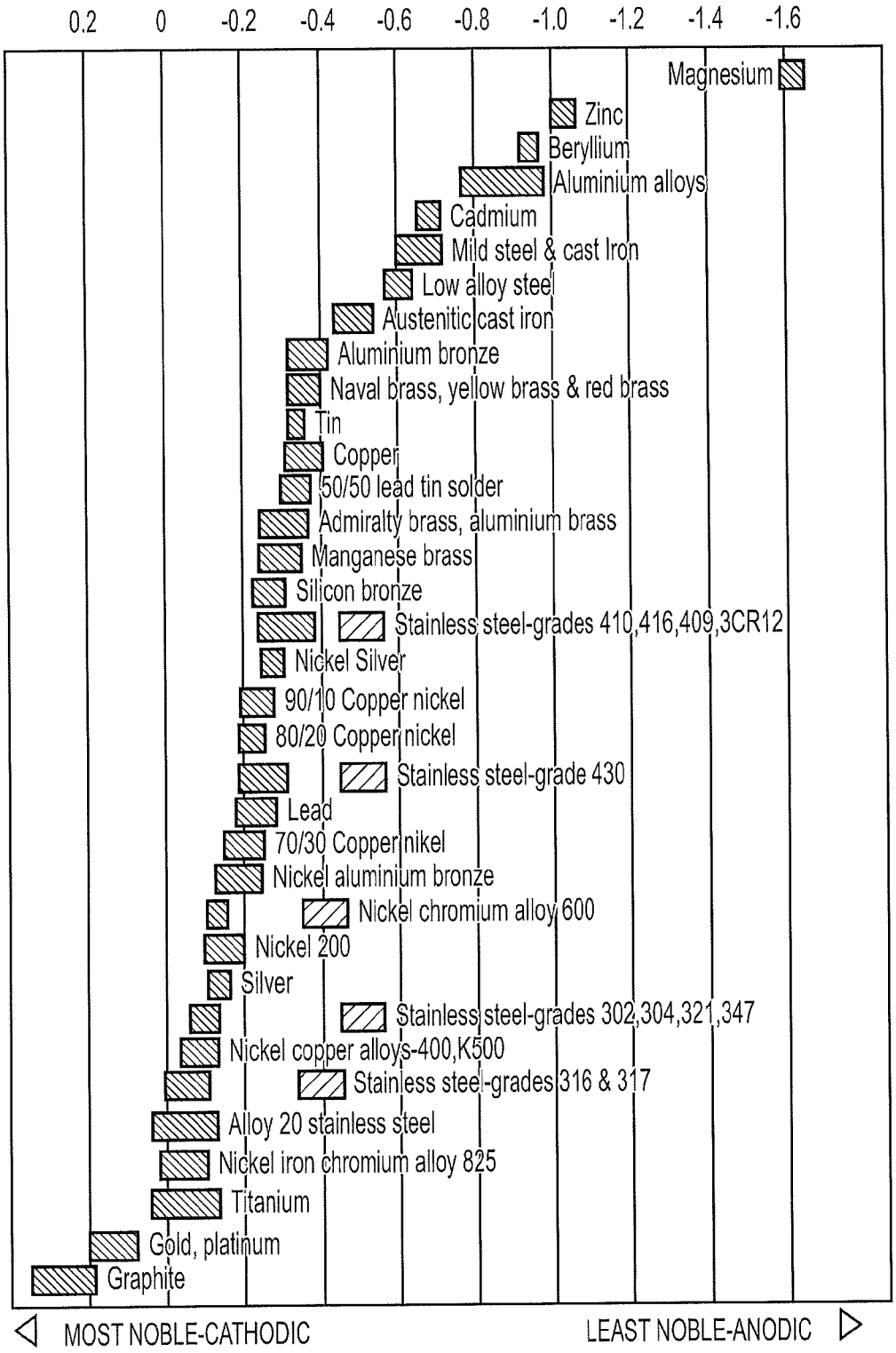
FIG. 1 shows the electrochemical series for a range of different metals in seawater at 20° C.
Figure 2:
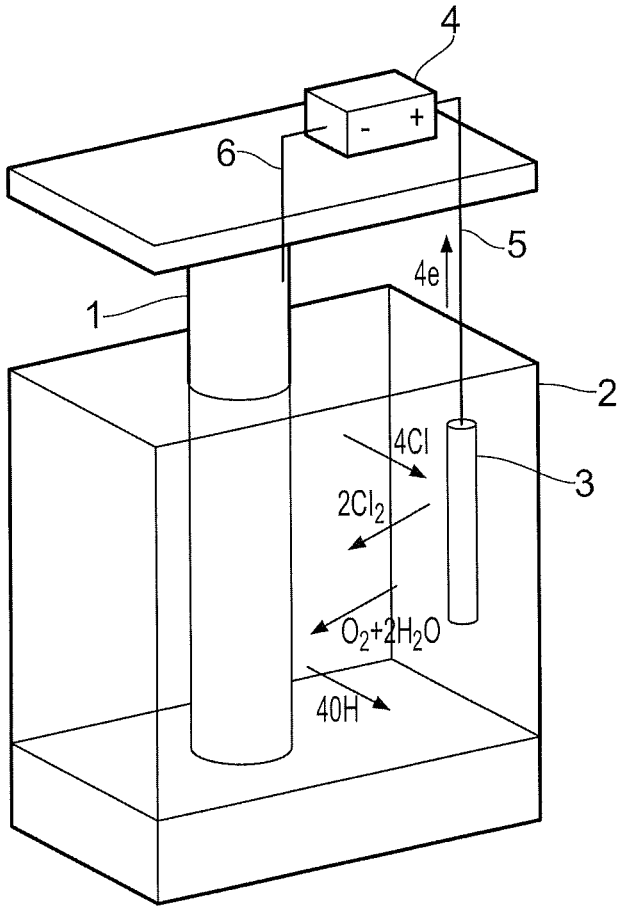
FIG. 2 is a schematic illustration showing a prior art impressed current cathodic protection system.

The first anode 32 is made from a metal which is higher in the galvanic series than the metal of the water-jet's structure, so as to have a greater negative potential than the protected metal of the water-jet 10. Thus, in the case of the water-jet's structure being formed of steel, having regard to FIG. 1, it will be noted that the first anode may be made from magnesium, zinc, or aluminium. FIG. 8 shows the first anode 30 being made from magnesium.

The protection system 29 also has a second anode 33, which takes the form of an impressed current anode. The second anode 33 is provided on or adjacent the metal structure of the water-jet 10 at a second position 34, which is spaced from and thus remote from the first position 31, and which in the arrangement illustrated in FIG. 8 is adjacent the intake duct 15 of the water-jet 10. As will be noted, in the arrangement illustrated, the second anode 33 is furthermore recessed into the sidewall of the metal intake duct 15 so as to be provided substantially flush with the inner surface of the duct 15. The second anode 33 is thus also provided at a position 34 which is substantially submerged in the seawater and which is thus exposed to seawater drawn through the intake duct 15 during operation of the water-jet 10. The second anode 33 is electrically connected to the first anode 30 by an insulated anode cable 35, and is in contact with the sidewall of the duct 15 such that the second anode 33 is electrically connected to the protected metal structure. Consequently, the first anode 30 is not in direct electrical contact with the protected metal structure, but only via the second anode 33, which is located at a location spaced from the location of the first anode 30.

As will be understood, the external surface of the water-jet housing 17 experiences a relatively low velocity water flow in use, roughly equivalent to the speed of the vessel in use (i.e. of the order of a few tens of knots). Consequently, the hydrodynamic penalty of provided a sacrificial anode (which may project into the water flow) in this location is relatively low. In contrast, the second anode (which is generally not sacrificial) is located on an inner surface of the intake duct 15, which experiences relatively high velocity water flows. Consequently, the hydrodynamic penalty of installing a sacrificial anode in this location would be relatively high. This embodiment therefore provides substantial hydrodynamic advantages, in that the sacrificial anode can be relocated to a more convenient, lower velocity water flow location, thereby reducing overall drag of the vessel. It will be understood that such a principle is applicable to any situation in which it is desirable to protect a structure which experiences high velocity water flow, without encountering the consequent hydrodynamic penalties of providing a sacrificial anode in this location.

The second anode 33 can be made of a material selected from various possibilities, including: magnetite, carbonaceous materials (such as graphite), high silicon iron (having 14-18% Si), lead or lead oxide, lead alloys, and platinised materials (such as tantalum, niobium, and titanium). Platinum has a very high resistance to corrosion and so in some respects would represent an ideal material for the second anode 33. However, due to its very high cost it is envisaged that platinum would not be regularly used. In general, it is desirable that the second anode has a lower negative potential than the first anode, and perhaps a lower negative potential than the structure to be protected, such that the second anode does not corrode over time.

The first anode 30 and the metal of the external part of the water-jet housing 17 cooperate to define a so-called "seawater battery" on account of their difference in negative potential, with the anode 30 representing the battery anode and the metal of the water-jet structure representing the battery cathode. The seawater surrounding the first anode 30 and the external part of the water-jet structure represents the electrolyte of the seawater battery, and the insulating material 32 between the anode 30 and the water-jet structure serves as the battery dielectric. The resulting seawater battery thus replaces the DC power supply 26 of the arrangement illustrated in FIG. 7, and thus provides current to the second anode 33 via the anode cable 35, such that the second anode 33 thereby functions as an impressed current anode to provide local corrosion protection to the intake duct 15 of the water-jet 10. The arrows 36 in FIG. 8 denote current flowing from the impressed current anode 33 to the metal structure of the water-jet through the seawater inside the intake duct 15.

As will be appreciated, the protection system 29 thus provides an ICCP system to protect the intake duct 15 and the neighbouring parts of the metal water-jet structure, but is powered by a seawater battery comprising the first anode 30. The system of the present invention thereby allows convenient use of an impressed current anode in the region of the intake duct 15, without the normally associated problem of needing to provide a separate DC power supply which arises with conventional ICCP systems.

As will be appreciated, over time the first anode 30 will be depleted or "sacrificed" and will therefore require periodic replacement. However, the convenient position of the first anode on the external part of the water-jet structure means that this can be achieved relatively easily, and certainly without the associated access problems which arise inside the intake duct 15. Inspection of the condition of the first anode 30 is also easy due its convenient external location. It is to be noted however that because the first anode 30 is electrically insulated from the metal structure of the water-jet 10 by the insulator 32, it will not actually provide effective cathodic protection to the external part of the water-jet itself. It is therefore proposed that the system 29 may be supplemented with one or more conventional sacrificial anodes connected directly to and in electrical connection with the external part of the water-jet in order to protect that part of the water-jet.

As will be appreciated, the cathodic protection system described above does not require the provision of anodes protruding into the intake water flow within the intake duct 15, which allows maximum flow efficiency to be maintained. Furthermore, because the second anode 33 is a permanent anode which is not depleted over time, the arrangement obviates the need to inspect or replace anodes in the inaccessible region of the intake duct, thereby reducing the maintenance burden. By providing a seawater battery to power the ICCP aspect of the arrangement, no independent physical battery or mains power supply is needed, thereby simplifying the overall system. Furthermore, it has been found that by carefully sizing the external first anode 30 of the arrangement, and through appropriate selection of material for the anode, it is possible to eliminate the need for an active control system which is a common aspect of conventional ICCP systems.

Of course, whilst the present invention has been described above with reference to a particular embodiment, it is to be appreciated that various changes and modifications can be made without departing from the scope of the invention. For example, whilst the embodiment described above and illustrated in FIG. 8 has only a single external first anode 30 and a single internal second anode 33, variants are envisaged that may have more than one of each anode.

Furthermore, whilst the invention has been described above in the context of providing corrosion protection to a marine water-jet unit 10, the protection arrangement of the present invention is not limited to this particular type of application. Indeed, the protection arrangement of the present invention is applicable to any application where corrosion protection of a metal structure is required in a difficult to access or remote area, or areas where it is important not to impede the hydrodynamic performance of the protected structure. Other applications may therefore include: Desalination plants, Chemical/nuclear/power plant installations cooled by water; pumps, Impellers; vessel propulsion devices, bow thrusters, propellers and steering gear.

When used in this specification and claims, the terms "comprises" and "comprising" and variations thereof mean that the specified features, steps or integers are included. The terms are not to be interpreted to exclude the presence of other features, steps or integers.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A marine cathodic protection system configured to protect a metal structure exposed to seawater from corrosion, the system comprising a first anode mounted to the protected metal structure with an electrically insulating material located between the first anode and the protected metal structure at a first position, the first anode being exposed to seawater and electrically insulated from the protected metal structure, and the first anode being formed of a metal having a greater negative potential than the protected metal;

and a second anode provided on or adjacent the protected metal structure at a second position, wherein the second anode is electrically connected to the first anode and is electrically connected to the metal structure to provide a protective current;

wherein the first anode and the second anode are different materials; and wherein said first position is substantially submerged in said seawater such that the protected metal structure and the first anode cooperate to define a seawater battery configured to apply an electrical current to the second anode, the second anode thus being an impressed current anode.

2. A system according to claim 1, wherein the second position is remote from the first position, and wherein the second anode is electrically connected to the first anode by an insulated cable.

3. A system according to claim 1, wherein the second position is also either submerged in said seawater, or otherwise exposed to said seawater.

4. A system according to claim 1, wherein said protected metal structure forms at least part of a marine propulsion device.

5. A system according to claim 1, wherein said protected metal structure comprises a first portion subjected to a relatively low velocity water flow in use, and a second portion subjected to a relatively high velocity water flow in use, the first anode being mounted to the first portion, and the second anode being mounted to the second portion.

6. A system according to claim 1, wherein said protected metal structure forms part of a propulsive water-jet system for a marine vessel.

7. A system according to claim 6, wherein said water-jet system comprises an external part which is located externally of the vessel's hull for submersion in seawater, and an intake duct at least part of which is located internally of the vessel's hull and which defines a flow channel for the intake of water, said first position being on or adjacent the external part, and said second position being within or adjacent said flow channel.

8. A system according to claim 7, wherein said second anode is recessed into said duct for exposure to water flowing through the duct.

9. A system according to claim 8, wherein at least part of said second anode is provided flush with a surface of said duct defining said flow channel.

10. A system according to claim 1, wherein said metal structure is formed substantially of a metal selected from the group comprising: steel, stainless steel and aluminium.

11. A system according to claim 1, wherein said first anode is made from a material selected from the group comprising: magnesium, zinc and aluminium, or alloys formed substantially of magnesium, zinc or aluminium.

12. A system according to claim 1, wherein said second anode is made from a material selected from the group comprising: magnetite, carbonaceous materials, silicon iron having a silicon content of between 14% and 18%, lead/lead oxide, lead alloys and platinised materials.

13. A system according to claim 1, wherein said second anode is made from graphite.

14. A system according to claim 1, wherein said second anode is made from a platinised material selected from the group comprising: tantalum, niobium and titanium.

15. A marine vessel provided with a system according to claim 1.

* * * * *